US005699903A

United States Patent [19]

Focke et al.

[11] Patent Number: 5,699,903

[45] Date of Patent: *Dec. 23, 1997

[54] PACK, NAMELY HINGE-LID PACK

[75] Inventors: Heinz Focke, Verden; Henry Buse, Visselhövede, both of Germany

[73] Assignee: Focke & Co. (GmbH & Co.), Verden, Germany

[ * ] Notice: The term of this patent shall not extend beyond the expiration date of Pat. No. 5,513,748.

[21] Appl. No.: 614,273

[22] Filed: Mar. 12, 1996

Related U.S. Application Data

[63] Continuation of Ser. No. 224,535, Apr. 7, 1994, Pat. No. 5,513,748.

[30] Foreign Application Priority Data

Apr. 8, 1993 [DE] Germany ..... 43 11 563.2

[51] Int. Cl.[6] ..... B65D 85/10

[52] U.S. Cl. ..... 206/268; 206/256; 206/261; 206/273; 229/120.03; 229/120.32; 229/160.1

[58] Field of Search ..... 206/256, 258, 206/261, 268, 273; 229/120.03, 160.1, 120.32

[56] References Cited

U.S. PATENT DOCUMENTS

| | | | |
|---|---|---|---|
| 1,104,529 | 7/1914 | Mendelson et al. | 206/256 X |
| 1,112,752 | 10/1914 | Avellanal | 206/256 |
| 1,158,826 | 11/1915 | Mendelson | 206/256 |
| 2,213,525 | 9/1940 | Laflamme | 229/121 |
| 2,367,476 | 1/1945 | Tyrseck . | |
| 3,039,671 | 6/1962 | Chiamerdas . | |
| 3,079,064 | 2/1963 | Ringler . | |
| 3,708,108 | 1/1973 | Rosenburg, Jr. . | |
| 4,200,221 | 4/1980 | Focke et al. . | |
| 4,204,353 | 5/1980 | Focke et al. . | |
| 4,779,737 | 10/1988 | Umehara et al. . | |
| 5,024,376 | 6/1991 | Focke . | |
| 5,074,412 | 12/1991 | White . | |
| 5,092,516 | 3/1992 | Kastanek . | |
| 5,161,733 | 11/1992 | Latif | 206/273 |
| 5,467,872 | 11/1995 | Minarelli | 206/256 |
| 5,513,748 | 5/1996 | Focke et al. | 206/268 |

FOREIGN PATENT DOCUMENTS

| | | |
|---|---|---|
| 0380898 | 8/1990 | European Pat. Off. . |
| 1105340 | 11/1958 | Germany . |
| 1993459 | 9/1968 | Germany . |
| 2135776 | 2/1973 | Germany . |
| 2350023 | 4/1975 | Germany . |
| 2551427 | 5/1977 | Germany . |
| 2800393 | 7/1979 | Germany . |
| 8803726 | 8/1989 | Germany . |

*Primary Examiner*—Bryon P. Gehman

*Attorney, Agent, or Firm*—Sughrue, Mion, Zinn, Macpeak & Seas, PLLC

[57] ABSTRACT

Pack, namely hinge-lid pack, made from thin cardboard, for cigarettes or other smoker's articles. Hinge-lid packs are conventionally structured in such a way that a lid (14, 15) is pivotably connected to a pack part (12, 13). To increase the receiving capacity, a double pack consisting of two individual hinge-lid packs (10, 11) is formed from a common one-piece blank. This is designed in such a way that the double pack is folded on the cross-winding principle and thereafter two end regions are each provided with a lid (14, 15). The lids (14, 15) are to be opened in opposite directions. Within the double pack, the individual hinge-lid packs (10, 11) are separated from one another approximately centrally by means of bottom walls (34, 35). The bottom walls (34, 35) are parts (bottom tabs 67) of the collar (36, 37).

27 Claims, 5 Drawing Sheets

PACK, NAMELY HINGE-LID PACK

This is a Continuation of application Ser. No. 08/224,535 filed Apr. 7, 1994, now U.S. Pat. No. 5,513,748.

BACKGROUND OF THE INVENTION

The invention relates to a pack, namely hinge-lid pack, made from thin cardboard, consisting of a pack part with a lid arranged on each of mutually opposite end regions of the latter and connected pivotably thereto, a double pack which consists of two individual hinge-lid packs being formed from a common blank.

Hinge-lid packs are known throughout the world as packaging for cigarettes. The hinge-lid packs conventionally consist of a pack part and of a lid connected to a rear wall of the latter. Within the pack part, there is arranged, in the region of the front wall and side walls, a collar of which a portion projects out of the pack part. The invention is concerned with a further development of packs of this type, namely with double packs having two hinge-lid packs.

SUMMARY OF THE INVENTION

The object on which the invention is based is to design the pack mentioned in the preamble, in such a way that the simplest possible production is possible.

To achieve this object, the pack according to the invention is defined in that, within the double pack, at least one bottom wall between the individual hinge-lid packs is formed from a separate blank.

In this double pack, a capacity for receiving two hinge-lid packs is provided. These consist of a common one-piece blank. The double pack is especially suitable for shorter elongate articles, particularly for shorter cigarettes or cigarette-like smoker's articles. The bottom wall provided according to the invention and consisting of a separate blank allows a simple handling of the double pack during production. The blank for the bottom wall can be assembled together with the blank for the double pack at the best possible moment.

According to a further feature of the invention, the bottom wall is designed as part of at least one collar within one of the individual hinge-lid packs. A pack according to the invention, in which each individual hinge-lid pack has a collar, which, by virtue of appropriate dimensioning and design, forms the bottom wall of the individual hinge-lid pack, is especially advantageous. The double pack according to the invention consequently has a double-layer bottom wall.

The double pack according to the invention consists of a one-piece blank which is constructed on the cross-winding principle. Accordingly, blank regions for forming the front wall, rear wall, lid front wall and lid rear wall are arranged next to one another, side walls and lid side walls being formed between corresponding main walls of the blank or of the pack. An overlap of the blank in the region of an edge strip takes place in the region of one of the two side walls or lid side walls. The blank thus designed is provided with punching cuts for delimiting the lid from the pack part. The punching cuts are connected to the blank by means of severable residual connections.

Further particulars of the invention are explained in more detail below by means of exemplary embodiments. In the drawing:

DESCRIPTION OF PREFERRED EMBODIMENTS

Figure 1:
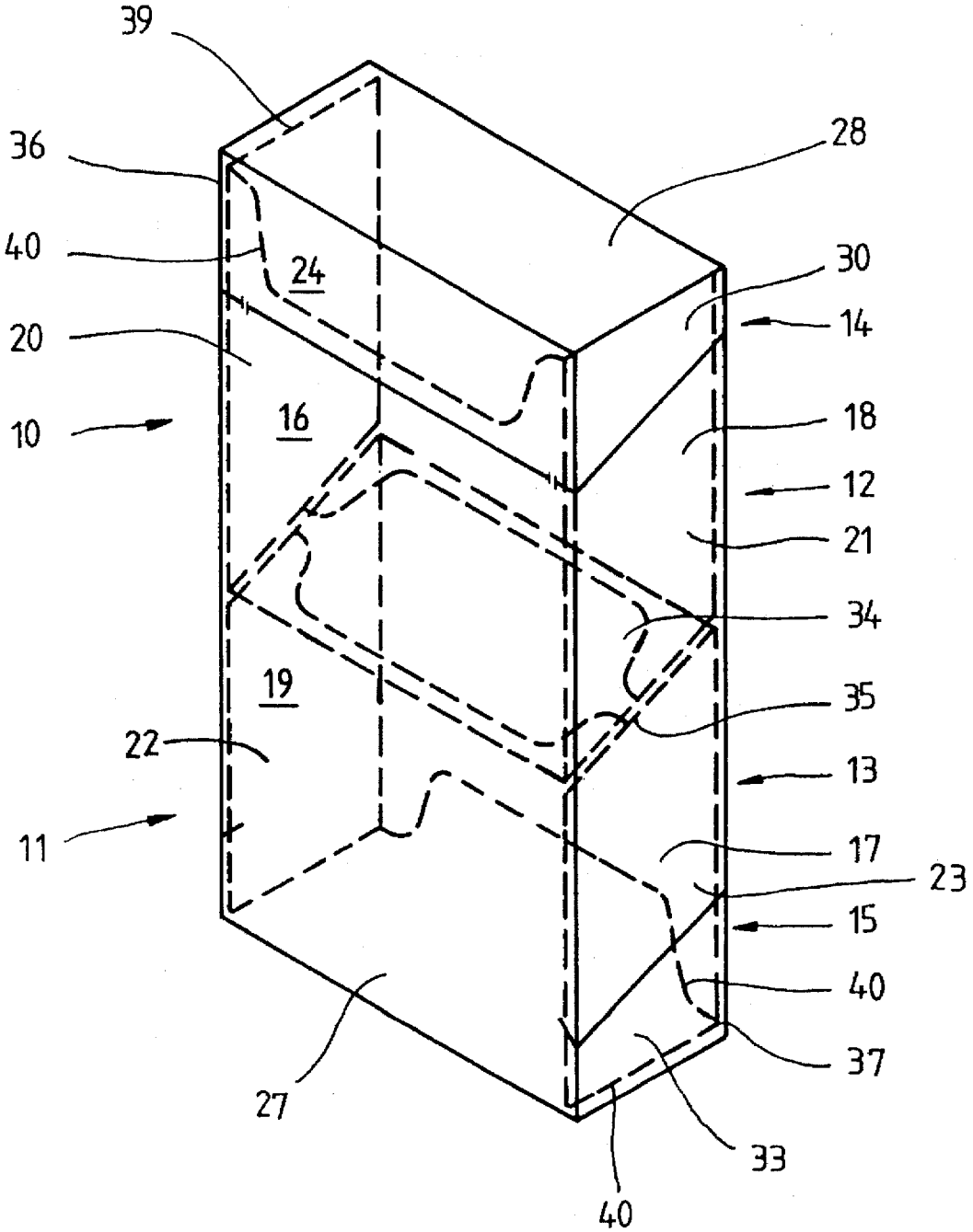
FIG. 1 shows an exemplary embodiment of a pack (double pack) according to the invention in a perspective representation.

The below described hinge-lid packs serve preferably for receiving (shorter) cigarettes or other similar stick-shaped smoker's articles. The hinge-lid pack is designed as a double pack, namely with two individual hinge-lid packs 10 and 11. Each of these part packs is designed as a hinge-lid pack, namely with a pack part 12 and 13 and with a lid 14 and 15. In a position of the pack according to FIG. 1, an upper individual hinge-lid pack 10 and a lower individual hinge-lid pack 11 are obtained. In this position, therefore, the lids 14 and 15 assigned to the two individual hinge-lid packs 10, 11 are likewise formed at the top and bottom. A further special feature is that the lids 14 and 15 are laterally reversed or are offset at 180° relative to one another.

Each pack part 12, 13 consists of a front wall 16 and 17, of a rear wall 18 and 19 and of side walls 20, 21 and 22, 23.

The lid 14 is designed correspondingly, namely consists, in each case, of a lid front wall 24, 25, of a lid rear wall 26, 27, of a lid top wall 28, 29 and of lid side walls 30, 31 and 32, 33.

The two individual hinge-lid packs 10, 11 are separated from one another on the inside by a transversely directed bottom wall. In the present example, each individual hinge-lid pack 10, 11 is assigned its own bottom wall 34, 35. In this exemplary embodiment, therefore, the double pack is subdivided into the two individual hinge-lid packs by an approximately central double-layer partition wall.

Furthermore, a collar 36, 37 consisting of an independent blank (FIG. 6) is arranged in each individual hinge-lid pack 10, 11. This collar consists of a collar front wall 38 and collar side tabs 39, 40. The collar 36, 37 extends, in each ease, in the region of the front walls 16, 17 and of the side walls 20 to 23.

The entire double pack, with the exception of the blanks for the collars 36, 37, consists of a one-piece common blank. According to the exemplary embodiments of FIG. 4 and FIG. 5, this is constructed on the cross-winding principle.

In the first-mentioned exemplary embodiment, the blank consists of two main walls 41, 42. These are dimensioned in such a way that they each jointly form a lid front wall 24 and 25, a front wall 16 and 17, a rear wall 18 and 19 and a lid rear wall 26 and 27. The main walls thus form the entire front or rear side of a double pack.

Located within the blank between the main walls 41, 42 thus dimensioned is a side-wall strip 43. This too extends over the entire height of the double pack, and therefore forms, in each case, one of the side walls 22, 23 of the individual hinge-lid packs 10, 11 and one of the lid side walls 32, 33.

Attached to the free side of one main wall 41 is a second side-wall strip 44. This likewise extends over the entire height of the double pack, to form side walls 20, 21 and lid side walls 30, 31.

Figure 3:
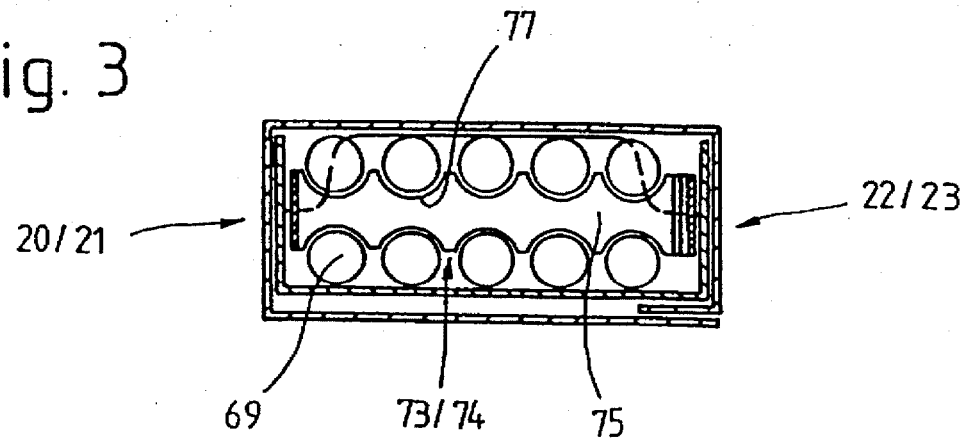
FIG. 3 shows the pack according to FIGS. 1 and 2 in horizontal section.

To form a pack of closed (cuboid) cross-section, an edge strip 45 is attached to the free side of the side-wall strip 44 and becomes or is connected (FIG. 3) to an edge region of the inside of the main wall 42, specifically by adhesive bonding. The edge strip 45 extends over the entire height of the double pack and therefore over the entire length of the main walls 41, 42.

To form the lid top walls 28, 29 (which also form the two opposite end of the double-pack (10, 11)), folding tabs are arranged on the free narrow sides of the main walls 41, 42 and of the side-wall strips 43, 44. These folding tabs are an inner lid tab 46 and an outer lid tab 47. These are folded one on top of the other over their entire area. Corner tabs 48, 49 are formed in the region of the side-wall strips 43, 44. These corner tabs are likewise folded into the plane of the lid top wall 28, 29, specifically on the inside, that is to say directly facing the pack content.

Figure 2:
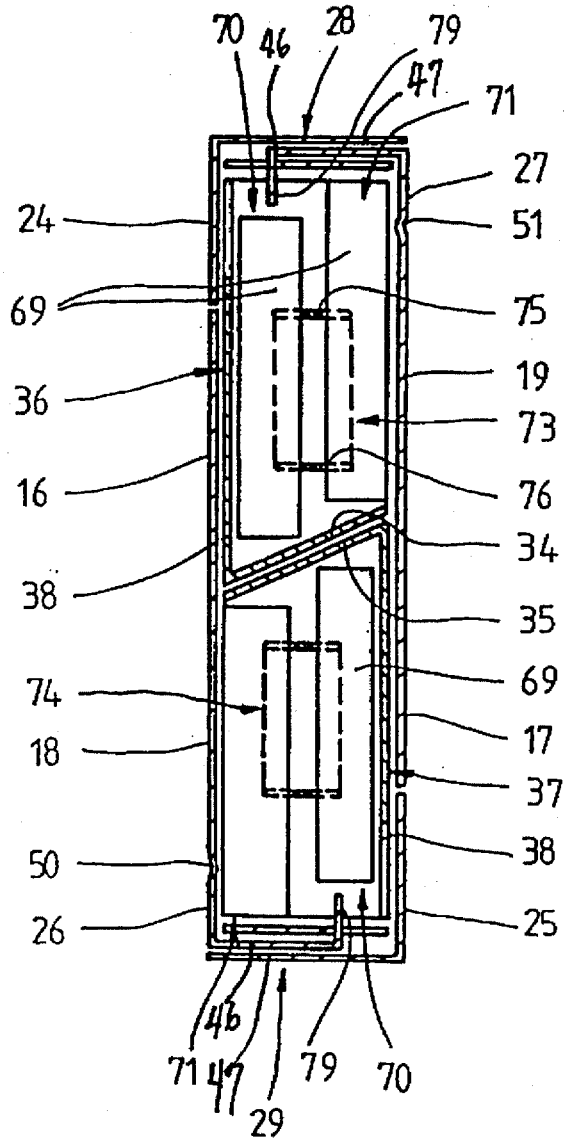
FIG. 2 shows the pack according to FIG. 1 in vertical section.

In the region of the main walls 41, 42 and of the side-wall strips 43, 44, the described parts or walls of the individual hinge-lid packs 10, 11 are separated from one another by means of folding lines or punching cuts. The lid rear walls 26 and 27 formed on mutually opposite end regions of the main walls 41, 42 are delimited relative to the rear walls 18 and 19 by means of a folding line which at the same time act as a hinge line 50, 51 of the individual hinge-lid packs 10, 11 (see also FIG. 2). The lid front walls 24 and 25 likewise formed in the region of the main wall 41, 42 are respectively divided off from the adjacent front wall 16, 17 by means of a transversely directed punching cut 52, 53. The punching cuts 52, 53 extend over the entire width of the main walls 41, 42, but are provided with residual connections 54 or residual webs, specifically, in the example shown, with two residual connections 54 arranged at a distance from one another. These ensure the sufficient cohesion of the blank in the region of the main walls 41, 42, especially also during the production or folding of the pack. When the latter is used, namely when the lid 14 or 15 is opened for the first time, the residual connections 54 are severed, so that the lid front wall 24, 25 is freed from the adjoining front wall 16, 17.

The punching cut 52, 53 of the main wall 41 or 42 has a continuation in the region of the adjacent side-wall strips 43, 44. In the region of the main wall 41, oblique cuts 55, 56 adjoin the two ends of the punching cut 52. These oblique cuts 55, 56 extend at an angle to the punching cut 52 in the region of the side-wall strips 43 and 44. The oblique cuts 55, 56 define an obliquely directed closing or butting edge, conventional in hinge-lid packs, in the region of side walls 20 to 23 of a hinge-lid pack, namely as a delimitation between the pack part 12, 13 and the lid 14, 15 (see also FIG. 1).

Similarly, an oblique cut 57 is provided adjoining the punching cut 53 in the region of the side-wall strip 43, specifically on a side located opposite the oblique cut 56. To complete the delimitation between the lid 14 and pack part 12, a further oblique cut 58 is made in the region of the side-wall strip 44. In the ready-folded pack, this further oblique cut 58 takes effect as an addition or continuation of the punching cut 53 on the side located opposite the oblique cut 57. For this purpose, there is also made in the region of the edge strip 45 an additional cut 59 which adjoins the oblique cut 58 and which coincides with an edge portion of the punching cut 53 in the ready-folded pack. For the reasons described, a residual connection 60 is likewise provided in the region of the additional cut 59.

A double pack in the design according to FIG. 1 is formed from a blank of this type by tubular folding, the tube having a rectangular cross-section. After the connection of the edge strip 45 to the main wall 42, the lower and upper folding tabs 46 to 49 are folded. The pack produced thus far can then be opened on two opposite sides as a result of a pivoting of the lids 14, 15, these being pivotable in opposite directions.

Figure 4:
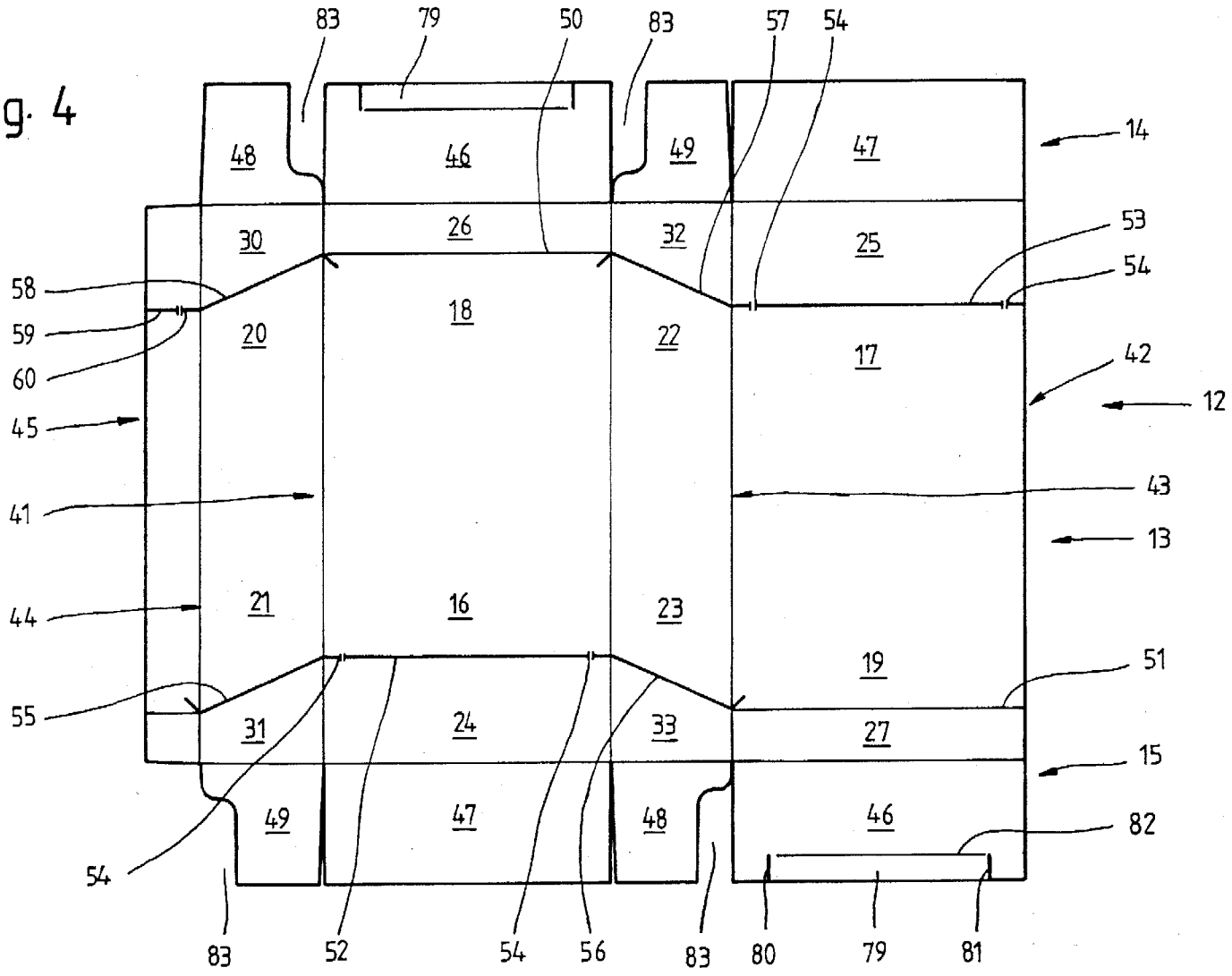
FIG. 4 shows a spread-out blank for a pack according to FIGS. 1 to 3.
Figure 5:
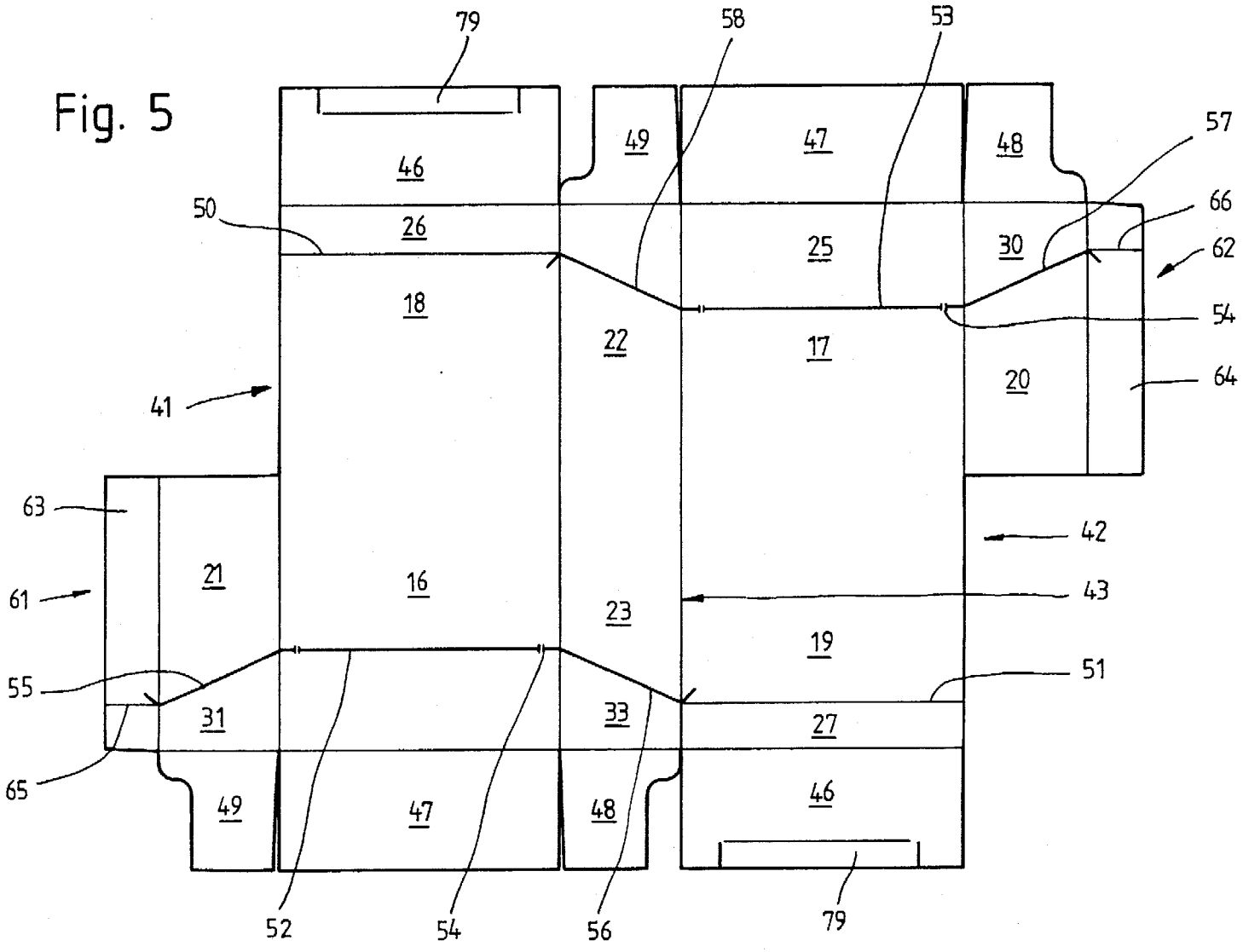
FIG. 5 shows a blank in a corresponding representation for another exemplary embodiment of a pack.

The blank according to FIG. 5 is of similar construction and leads to a pack, namely double pack, outwardly of virtually identical design. The difference is that, in this exemplary embodiment, the side-wall strip 44 located at the edge is divided and is assigned to the respective pack side or blank side. Part strips 61, 62, which each have half the dimension of the sidewall strip 44 according to FIG. 4, are accordingly attached to the otherwise free sides of the main walls 41, 42. As a result, the punching cuts 52, 53 described, together with the adjacent oblique cuts 55 and 56 or 57 and 58, can be made continuously and adjoiningly, so that continuous trapezoidal punching cuts are obtained in the regions of the blank which are located diametrically opposite one another.

The blank is processed to form the double pack in virtually the same way as in the exemplary embodiment of FIG. 4. Thus, the part strips 61, 62 are connected to otherwise free edge regions of the main walls 41 on the one hand and 42 on the other hand, specifically via corresponding edge strips 63, 64. However, in the region of these, there is no punching cut, but only a hinge addition 65, 66. This is a folding or embossing line which, in the finished pack, covers a part region, located at the edge, of the hinge line 50 and 51. In the finished pack (double pack), in this example there appears, in the region of 15 one longitudinal side, a division between the two pack parts 12, 13, namely a transversely directed joint as a butting point between the part strips 61, 62. The side walls 20 and 21 of the individual hinge-lid packs 10, 11 are thereby separated from one another by means of this butt joint.

Figure 6:
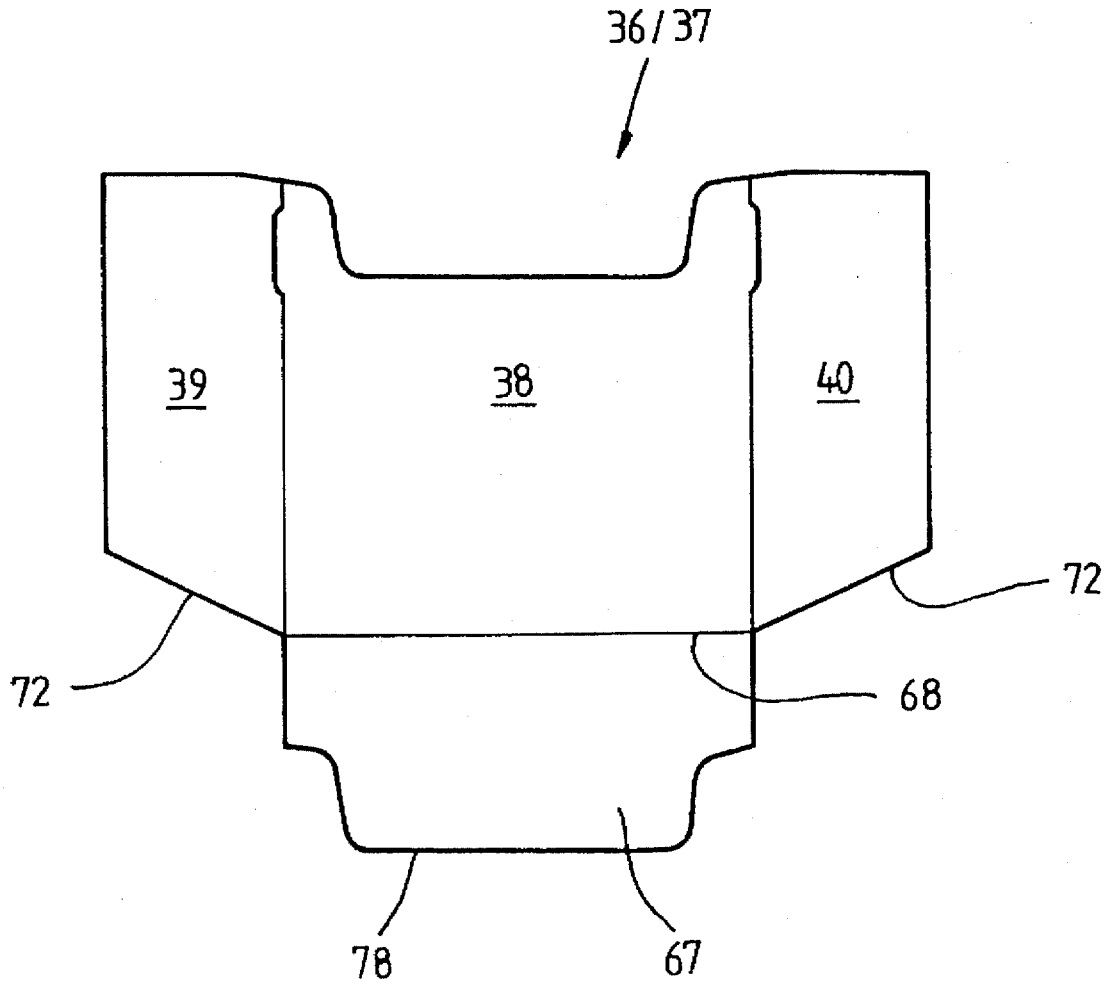
FIG. 6 shows a blank for a collar of the pack, likewise in a spread-out position.

A further particular feature of the pack is the formation of the bottom walls 34, 35. In the present case, these consist of part of the one-piece blank for the collar 36, 37 (FIG. 6). A bottom tab 67 is attached to the collar front wall 38 as a continuation of the collar front wall 38. This bottom tab 67 is folded about a folding line 68 into a transverse position in order to form a bottom wall 34, 35. The collar 36, 37 or the collar front wall 38 is, at the same time, dimensioned in such a way that it extends as far as the bottom wall 34, 35 of a pack part 12, 13, that is to say over the entire height of the front wall 16, 17. The folding line 68 at the same time forms an inner edge in the pack part 12, 13.

In the exemplary embodiment illustrated (FIG. 1), the bottom wall 34, 35 is directed obliquely relative to the front wall 16, 17 and rear wall 18, 19. Each individual hinge-lid pack 10, 11 thus acquires an oblique bottom wall 34, 35, specifically such that the bottom wall 34, 35 is, in each case, lower in the region of the front wall 16, 17 than in the region of the rear wall 18, 19.

To form a stable bottom wall 34, 35 directed obliquely, the bottom tab 67 of the collar 36, 37 is dimensioned in such a way that a stable oblique position is obtained automatically. The width of the bottom tab 67, that is to say the distance between the folding line 68 and a free supporting edge 78, is greater than the corresponding clear inner dimension of the individual hinge-lid packs 10, 11. As a result, the supporting edge 78 can be supported on the opposite wall, namely on the rear wall 18, 19, to form a stable oblique position. The supporting edge 78 has a contour which corresponds to the conventional upper contour of the collar front wall 38. The blanks can therefore to that extent be produced free of waste from a continuous material web.

As a result of the oblique position of the bottom wall 34, 35, a special positioning of the pack content in the individual hinge-lid packs 10, 11 is possible. The example shown relates to (short) cigarettes 69 which are arranged in two rows 70, 71 in each individual hinge-lid pack 10, 11, specifically at a distance from one another in each case. The rows 70, 71, by being supported on the oblique bottom wall 34, 35, assume a stepped position. The row 71 facing the rear wall 18, 19 projects upwards beyond the front row 70.

The collar side tabs 39, 40 likewise extend as far as the bottom wall 34, 35. To adapt to the oblique position of the latter, the collar side tabs 39, 40 are provided with a matching lower oblique edge 72.

In the exemplary embodiment illustrated, to position the cigarettes 69 in two rows 70, 71 and to form clearances between the cigarettes 69, a supporting member 73, 74 is arranged within each individual hinge-lid pack 10, 11. This supporting member 73, 74 is, in each case, arranged between the rows 70, 71 and at a distance from the lid 14, 15 and bottom wall 34, 35. Transversely directed supporting walls 75, 76 are provided with trough-like recesses 77. The cigarettes 69 rest positively in these. The cigarettes 69 are thereby fixed in respect of lateral movements. The supporting member 73, 74 is expediently connected to the side walls 20 to 23 and to the collar side tabs 39, 40 as an inner delimitation of the individual hinge-lid pack 10, 11. The connection can be made by adhesive bonding.

In order to stabilize the stepped position of the rows 70, 71, especially while the double pack is being used,.each individual hinge-lid pack 10, 11 is provided with a stop or holding-down device 79 for the lower, that is to say front row 70. The holding-down device 79 is designed, here, as part of the lid 14, 15, specifically as an edge strip of the inner lid tab 46, to form the lid top wall 28, 29. This edge strip has a shorter longitudinal dimension than the inner lid tab 46. The edge strip is delimited by lateral incisions 80, 81 in the inner lid tab 46 and is folded about a folding line 82 into a position transverse to the inner lid tab 46 in order to form the holding-down device 79. The holding-down device 79 thereby extends approximately centrally above the row 70.

The inner corner tabs 48, 49, namely those facing the pack content, are provided, on the side facing the inner lid tab 46, with a recess 83 formed by punching, that is to say are designed narrower in this region than the width of the side walls 20 to 23. In the ready-folded pack (FIG. 2), the holding-down device 79 passes through the strip-shaped gap thus produced.

We claim:

1. A hinge-lid pack assembly made from thin cardboard, and comprising a double pack made of a one-piece common blank, wherein said the double pack has two opposite ends, and comprises:

a pack part (12, 13) having two mutually opposite narrow pack side walls (20 to 23), two large pack walls (16 to 19), and two end walls, the two large pack walls (16 to 19) forming a front wall and a rear wall of the double pack; and first and second hinged lids (14, 15) on the opposite ends, respectively, of the double pack;

wherein said lids (14, 15) have two respective lid top walls (28, 29) which form said end walls of the double pack, two respective lid rear walls (26, 27), two respective lid front walls (24, 25), and respective pairs of lid side walls (30, 32 or 31, 33), wherein said two large pack walls (16 to 19) are connected in one piece via a common first side wall strip (43) to form one of the narrow pack side walls (22 to 23), and wherein the lid front walls (24, 25) are separated from respectively adjacent ones of the large pack walls by respective punching cuts (52, 53).

2. The hinge-lid pack assembly as claimed in claim 1, wherein each lid front wall (24, 25) is connected to one of the lid rear walls (26, 27) in one piece via one of the lid side walls (32, 33).

3. The hinge-lid pack assembly as claimed in claim 1, wherein the lids (14, 15) are hinged to opposite ones of said large pack walls, respectively.

4. The hinge-lid pack assembly as claimed in claim 1, wherein the lid front walls (24, 25) are respectively connected to the adjacent lid side walls (31, 33 or 30, 32) in one piece.

5. The hinge-lid pack assembly as claimed in claim 1, wherein the lid side walls (30 to 33) are separated from respectively adjacent ones of said narrow pack side walls (20 to 23) by respective punching cuts (52, 53).

6. The hinge-lid pack assembly as claimed in claim 5, further comprising residual blank portions which are spaced along the punching cuts (52, 53), and which connect the lid front wall (24, 25) to said adjacent large pack walls.

7. The hinge-lid pack assembly as claimed in claim 6, wherein the two large pack walls (16 to 19) are connected to one another, in a region of the pack side wall located opposite the first side wall strip (43), by a second side wall strip (44) having an edge strip (45), the second side wall strip (44) adjoining one of the pack walls (16, 18) in one piece, the edge strip (45) overlapping an edge region of the other pack wall (17, 19) and being connected thereto, the second side wall strip (44) being subdivided into a pack side wall and two lid side walls (30, 31) by oblique cuts (55, 58), and one of the oblique cuts (55, 58) being adjoined, a region of the edge strip (45), by an additional cut (59) with residual blank connections (60).

8. The hinge-lid pack assembly as claimed in claim 1, wherein at least one bottom wall (34, 35) is formed inside of the double pack, and subdivides the double pack into two individual hinge-lid packs (10, 11).

9. The hinge-lid pack assembly as claimed in claim 8, wherein a collar (36, 37) is arranged in each individual hinge-lid pack (10, 11), and comprises a collar front wall (38) and collar side walls (39, 40); and wherein the collar has a part which projects from the front wall (16, 17) and is covered by one of the lids (14, 15) in a closed position thereof.

10. The hinge-lid pack assembly as claimed in claim 9, wherein the bottom wall (34, 35) is formed by parts of each collar (36, 37).

11. A single blank for producing a hinge-lid pack assembly in the form of a double pack with two hinged lids, said single blank comprising a plurality of interconnected blank portions forming the following parts of the hinge-lid pack: two narrow side walls; two large pack walls; two lid top walls (28, 29); two lid rear walls (26, 27); two lid front walls (24, 25); and two pairs of lid side walls (30 to 33), the two large pack walls being connected in one piece via a common first side wall strip (43) to form one (22, 23) of the narrow side walls (22, 23) of the double pack, wherein the portion forming the large pack walls, opposite the second side wall strip (44), are each adjoined in one piece by respective ones of two part strips (61, 62), which are located opposite one another and which form one of the narrow side walls of the hinge-lid pack assembly.

12. A single blank for producing a hinge-lid pack assembly in the form of a double pack with two hinged lids, said single blank comprising a plurality of interconnected blank portions forming the following parts of the hinge-lid pack: two narrow side walls; two large pack walls; two lid top walls (28, 29); two lid rear walls (26, 27); two lid front walls (24, 25); and two pairs of lid side walls (30 to 33), the two large pack walls being connected in one piece via a common first side wall strip (43) to form one (22, 23) of the narrow side walls (22, 23) of the double pack, wherein:

a) first blank portions forming one of the lid rear walls (26), one of the large pack walls (16, 18) and one of the lid from walls (24) adjoin one another in one piece in a longitudinal direction of one large pack wall portion, thereby forming a first rectangle;

b) blank portions forming the other of the lid front walls (25), the other of the large pack walls (17, 19), and the other of the lid rear walls (27) adjoin one another in said longitudinal direction, thereby forming a second rectangle; and c) blank portions forming one of the lid side walls (32), one of the narrow side walls (22, 23), and another of the lid side walls (33) adjoin one another in the longitudinal direction, thereby forming a third rectangle;

d) the three rectangles adjoin one another in a direction transverse to said longitudinal direction in one piece, said one narrow side wall portion (22, 23) resting between: the two large pack wall portions (16 to 19) and, correspondingly, said one lid side wall portion (32) resting between said one lid rear wall portion (26) and said other lid front wall portion (25), and said other side wall portion (33) resting between said one lid front wall portion (24) and said other lid rear wall (27);

e) the two lid front wall portions (24, 25) are each separated from the adjoining large pack wall portions (16, 18 and 17, 19) by two transverse punching cuts (52, 53), respectively; and f) wherein two of the lid side wall portions (32, 33) are each separated from said one adjoining narrow side wall portion (22, 23) by first oblique punching cuts (56, 57).

13. The blank as claimed in claim 12, wherein:

a) another of said lid side wall portions (30), the other of said narrow side walls (20, 21), and still another of said lid side walls (31) adjoin one another in one piece in the longitudinal direction, thereby forming a fourth rectangle, b) said fourth rectangle adjoins said first rectangle via a large pack wall in the transverse direction and in one piece, and wherein said another lid side wall portion (30) borders on said one lid rear wall portion (26) and, correspondingly, the other narrow side wall portion on the large pack wall, and also still another lid side wall (31) on said one lid front wall portion (24);

c) an edge strip (45) adjoins said fourth rectangle in one piece in the transverse direction and extends as far as said fourth rectangle in the longitudinal direction;

d) said another and still another lid side wall portion (30, 31) are separated from said other narrow side wall portions (20, 21) by respective second oblique punching cuts (55, 58); and e) in a region of the edge strip (45), one of the second oblique cuts (58) is adjoined by an additional punching cut (59) extending in the transverse direction.

14. The blank as claimed in claim 13, wherein one each of said two transverse, said first oblique and said second oblique punching cuts (55, 52, 56) adjoin one another so as to form a continuous cut, and the other transverse and the other of each of said first and second oblique punching cuts (57, 53) also adjoin each other and form a further continuous cut.

15. The blank as claimed in claim 12, wherein:

a) said still another lid side wall portion (30) and a first partial side wall portion (20) adjoin one another in one piece in the longitudinal direction, thereby forming a first side surface portion;

b) said first side surface position adjoins, in one piece and in a transverse direction, one of the rectangles at junctures with one of said large pack wall portions, with said still another lid side wall portion (30) bordering on said other lid front wall portion (25) and, correspondingly, with said partial side wall portion (20) on said one large pack wall portion;

c) a second side surface portion adjoins, in one piece and in the transverse direction, another of the rectangles at junctures with a large pack wall, with the lid side wall portion (310 bordering on said one lid front wall portion (24) and, correspodingly, with the second partial side wall portion (21);

d) said first and second side surface portions are both adjoined in one piece by one part edge strip (61, 62) each, so that they are located diametrically opposite one another;

e) said lid side wall portions (30, 31) bordering on said lid front wall portions (24, 25) are each separated from the adjoining partial side wall portion (20, 21) by second and said first oblique punching cuts (57, 55); and f) first ones of said transverse, first and second oblique cuts (58,53,57) adjoin one another, thereby forming a first continuous cut, just as second ones of said transverse, first and second oblique cuts (55, 52, 56), which form a second continuous cut, the first and second continuous cuts being located opposite of on another via said one narrow wall portion (22, 23).

16. The blank as claimed in claim 13 or 15 wherein the cuts (52, 53) between the lid front wall portions (25, 26) and large pack wall portions are each interrupted by residual connections (54) in the blank.

17. The blank as claimed in claim 13 or 15, wherein each of the lid side wall portions (30, 31) is adjoined by one corner tab portion (48, 49) in one piece in the longitudinal direction.

18. The blank as claimed in claim 12, wherein said three rectangles are adjoined, on both sides and in one piece, by the blank portions for forming the lid top walls (28, 29), and by blank portions for forming two lid inner tabs (46), two corner tabs (49, 48), and two outer lid tab (47).

19. A hinge-lid pack assembly made from thin cardboard, and comprising a double pack made of a one-piece common blank, wherein said the double pack has two opposite ends, and comprises:

a pack part (12, 13) having two mutually opposite narrow pack side walls (20 to 23), two large pack walls (16 to 19), and two end walls, the two large pack walls (16 to 19) forming a front wall and a rear wall of the double pack; and first and second hinged lids (14, 15) on the opposite ends, respectively, of the double pack;

wherein said lids (14, 15) have two respective lid top walls (28, 29) which form said end walls of the double pack, two respective lid rear walls (26, 27), two respective lid from walls (24, 25), and respective pairs of lid side walls (30, 32 or 31, 33), wherein said two large pack walls (16 to 19) are connected in one piece via a common first side wall strip (43) to form one of the narrow pack side walls (22 to 23), and wherein the first lid (15) is hinged via its lid rear wall (27) to one of the large pack walls (16, 18) and the second lid (14) is hinged via its lid rear wall (26) to the other large pack wall (17, 19).

20. The hinge-lid pack as claimed in claim 19, wherein at least one bottom wall (24, 35) is formed within the double pack, the bottom wall (34, 35) subdividing the double pack into two individual hinge-lid packs (10, 11).

21. The hinge-lid pack assembly as claimed in claim 20, wherein, in each individual hinge-lid pack (10, 11), there is a separate collar (36, 37) comprised of a collar front wall (38) and collar side walls (39, 40), a part of the collar projecting front the front wall (16, 17) and being covered by said lid (14, 15) in a closed position thereof.

22. A single blank for the production of a hinge-lid pack assembly having two hinge lids, with one hinge lid each at two mutually opposite narrow end walls of a finished hinge-lid double pack, said blank comprising:

a) two large wall portions (16, 18 and 17, 19) for forming mutually opposite large pack walls in the finished hinge-lid pack;

b) a first long narrow side wall portion (22, 23) for forming a narrow first pack side wall in the finished hinge-lid pack;

c) a second long narrow side wall portion (20, 21) for forming a second narrow side wall in the finished hinge-lid pack; and d) lid end tab portions (47), lid front wall portions (24, 25), lid rear wall portions (26, 27), lid side wall portions (30 to 33) and lid corner tab portions (48, 49) for forming the lids, e) wherein the two large wall portions (16, 18 and 17, 19) are connected to one another at sides thereof via the first long narrow side wall portion (22, 23) which adjoins said sides, f) wherein, at a narrow end thereof, one of the two large wall portions (16, 18) is adjoined by the lid rear wall portion (26) of one of the lids (14) and, at the opposite end thereof, by the lid front wall portion (24) of the other lid (15), g) wherein at a narrow end thereof, the other of said two large front wall portions (17, 19) is adjoined by the lid rear wall portion (27) of the other lid, and, at the opposite end thereof, by the lid front wall portion (25) of the one lid, h) wherein the lid rear wall portion (26) of the one lid (14) is connected with the lid front wall portion (25) of the one lid via one (32) of the lid side wall portions to form the one lid (14), i) wherein the lid rear wall portion (27) of the other lid (15) is connected with the lid front wall portion (24) of the other lid (15) via another (33) of the lid side wall portions to form the other lid (15), and j) wherein at a narrow side thereof, the first long narrow side wall portion (22, 23) is adjoined by the one lid side wall portion (32), and, at an opposite narrow side thereof, by the other lid side wall portion (33).

23. The single blank as claimed in claim 22, wherein one of the two large wall portions is adjoined by said second long narrow side wall portion (20, 21) in one piece, the entire second long narrow side wall portion (20, 21) extending over almost the full length of said one large wall portion.

24. The blank as claimed in claim 22, wherein the second long narrow wall portion (20, 21) for forming the narrow first pack side wall adjoins the one large wall portion (16, 18) on the side thereof opposite the adjoining first long narrow wall portion (22, 23).

25. The blank as claimed in claim 24, wherein, at a side opposite the adjoining one large wall portion (16, 18), the second long narrow wall portion (20, 21) is adjoined by an edge strip (45) for forming an overlapping connection with the other large wall portion (17, 19) in the finished double pack.

26. The blank as claimed in claim 25, wherein the edge strip (45) is subdivided by a transversely directed cut (59) adjoining one (58) of the cuts which is between one of the lid side wall portions (30) and the second long, narrow wall portion (20, 21).

27. The blank as claimed in claim 22, wherein the lid side wall portions (30 to 33) are separated from the large wall portions (16, 18 and 17, 19), and are separated from the first and second narrow wall portions (20 to 23), by cuts (52, 53, 55 to 58), and are connected to one another only by residual blank connections (54).

* * * * *